US008690108B2

(12) United States Patent
Detterbeck et al.

(10) Patent No.: US 8,690,108 B2
(45) Date of Patent: Apr. 8, 2014

(54) RAIL VEHICLE

(75) Inventors: Manfred Detterbeck, Wendelstein (DE); Guido Wolf, Baunach (DE)

(73) Assignee: Siemens Aktiengesellschaft, Munich (DE)

( * ) Notice: Subject to any disclaimer, the term of this patent is extended or adjusted under 35 U.S.C. 154(b) by 167 days.

(21) Appl. No.: 13/498,978

(22) PCT Filed: Aug. 25, 2010

(86) PCT No.: PCT/EP2010/062395

§ 371 (c)(1),
(2), (4) Date: Mar. 29, 2012

(87) PCT Pub. No.: WO2011/039002

PCT Pub. Date: Apr. 7, 2011

(65) Prior Publication Data

US 2012/0181391 A1 Jul. 19, 2012

(30) Foreign Application Priority Data

Sep. 29, 2009 (DE) ..... 10 2009 048 666

(51) Int. Cl.
*B61L 3/12* (2006.01)
*B61L 3/22* (2006.01)

(52) U.S. Cl.
USPC ..... 246/194; 246/63 R

(58) Field of Classification Search
USPC ... 246/167 R, 194, 34 R, 34 B, 63 R, 8, 63 C, 246/63 A; 455/41.1; 307/104
See application file for complete search history.

(56) References Cited

U.S. PATENT DOCUMENTS

| | | | | |
|---|---|---|---|---|
| 5,021,725 | A * | 6/1991 | Jimbo et al. | 318/801 |
| 5,242,136 | A | 9/1993 | Cribbens et al. | |
| 5,713,541 | A * | 2/1998 | Schmitz et al. | 246/187 A |
| 6,321,170 | B1 * | 11/2001 | Wurgler et al. | 702/76 |
| 6,527,230 | B1 * | 3/2003 | Frick | 246/194 |
| 6,597,137 | B1 * | 7/2003 | Griepentrog et al. | 318/434 |
| 6,810,088 | B1 * | 10/2004 | Griepentrog et al. | 375/259 |
| 7,017,864 | B2 * | 3/2006 | McAllister | 246/34 R |

FOREIGN PATENT DOCUMENTS

| | | | |
|---|---|---|---|
| EP | 2082943 | A2 | 7/2009 |
| GB | 148990 | A | 10/1921 |
| RU | 2232691 | C2 | 7/2004 |
| WO | 9107302 | A1 | 5/1991 |

* cited by examiner

*Primary Examiner* — Mark Le

(74) *Attorney, Agent, or Firm* — Laurence A. Greenberg; Werner H. Stemer; Ralph E. Locher

(57) ABSTRACT

A rail vehicle has at least one vehicle antenna of a train safety system directed toward the track. To increase resistance to interference, the rail vehicle is configured such that the body of the rail vehicle and an axle arranged in the region of an end of the rail vehicle are electrically connected by way of a capacitive connection and the at least one vehicle antenna is arranged at a greater distance from the end of the rail vehicle than the axle that is electrically connected to the body.

15 Claims, 1 Drawing Sheet

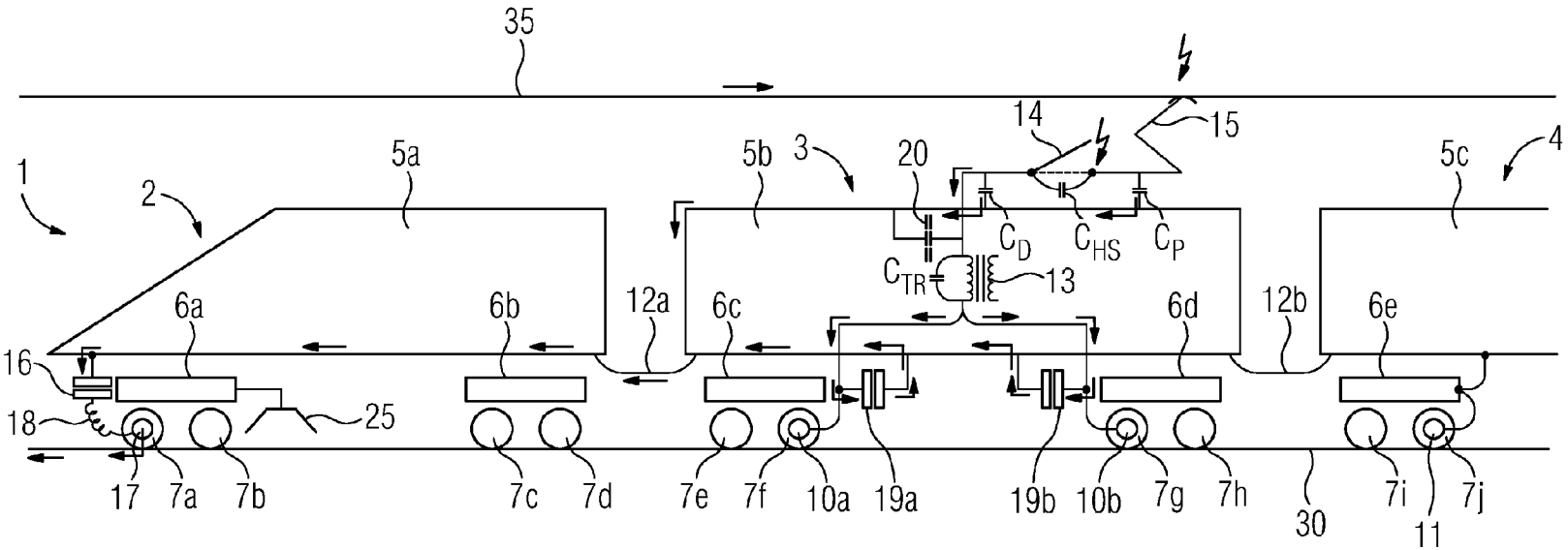
4
5c
6e
7j
11
7i
30
12b
15
6d
7h
7g
10b
$C_P$
$C_{HS}$
14
13
19b
$C_D$
20
$C_{TR}$
19a
10a
3
5b
7f
6c
7e
12a
7d
35
6b
7c
5a
25
7b
6a
7a
2
17
1
16
18

RAIL VEHICLE

BACKGROUND OF THE INVENTION

Field of the Invention

The present invention relates to a rail vehicle having at least one vehicle antenna of a train protection system, said vehicle antenna being directed toward the track.

Rail vehicles of the mentioned type are generally known, wherein the vehicle antennas of corresponding rail vehicles are generally used for transmitting data between a line-side device, for example in the form of a balise, which is arranged in the track and the rail vehicle. Depending on the respective train protection or train control system and the nature of the respective line-side device, in this case vehicle antennas of different types can be used.

Vehicle antennas directed toward the track, i.e. substantially downwardly directed vehicle antennas, can have the problem, in particular depending on the type of respective rail vehicle, that they can be influenced by electrical interference. Therefore, in the case of those rail vehicles which draw their energy required for locomotion from an overhead line or a contact rail, in practice unavoidable electrical sparking results between the vehicle-side current collector and the catenary wire or the contact rail, as a result of which transient interference is produced in the traction current. In this case, transient interference is referred to as non-periodic interference which often has comparatively steep rising flanks and comparatively high peaks. Corresponding transient interference is also brought about by the master switch of a rail vehicle driven by an electric motor being switched on and off. During operation, the sparking between the catenary wire and the current collector occurs in particular at discontinuities in the catenary wire, such as when traversing branch-off points or phase separation points.

The described spark-producing phenomena generate, in the same way as a noise generator, a very wide-band, transient interference spectrum, which is superimposed on the traction current and the reverse current, i.e. flows in the overhead line or the catenary wire and in the rails. In this case, the circuit of the transient interference currents is closed via parasitic capacitances between the overhead line system and the rail. That proportion of the sparking interference spectrum which is superimposed on the reverse current can now in particular influence those train protection systems which function with vehicle antennas directed toward the track.

Furthermore, transient interference which is brought about by the operation of other rail vehicles for the case in which a plurality of rail vehicles are located on the same substation section, can also influence or represent interference for the train protection system or the vehicle antennas of other rail vehicles via the transient reverse currents in the rails. This means that corresponding interference can in principle also influence those rail vehicles which are not themselves driven by electric motor.

BRIEF SUMMARY OF THE INVENTION

The present invention is based on the object of specifying a rail vehicle having at least one vehicle antenna of a train protection system, said vehicle antenna being directed toward the track, by means of which rail vehicle the interference immunity of the train protection system is increased.

This object is achieved according to the invention by a rail vehicle having at least one vehicle antenna of a train protection system, said vehicle antenna being directed toward the track, wherein the carriage body of the rail vehicle and an axle, which is arranged in the region of one end of the rail vehicle, are electrically connected to one another by means of a capacitive connection, and the at least one vehicle antenna is arranged at a greater distance from the end of the rail vehicle than the axle, which is electrically connected to the carriage body.

The rail vehicle according to the invention is therefore characterized by the fact that its carriage body and an axle arranged in the region of one end of the rail vehicle are electrically connected to one another by means of a capacitive connection. In this case, the wording "carriage body of the rail vehicle" in the context of the description of the present invention also includes those rail vehicles which comprise a plurality of carriages or carriage parts. In this case, the carriage body of the rail vehicle which is electrically connected to the axle by means of the capacitive connection is therefore the carriage body of one of the carriages or carriage parts of the rail vehicle.

The invention is based on the basic concept of guiding the interference spectrum in the reverse current not along the active side of the vehicle antenna toward the track bed, but along the passive side of the vehicle antenna, i.e. above the vehicle antenna, in the carriage body. Consideration should be taken here of the fact that vehicle antennas generally have pronounced directivity and are comparatively insensitive upwards toward the carriage body owing to different measures, such as corresponding shielding, for example.

In general, however, it is now not desirable for the purpose of rerouting the transient interference currents to also guide the traction current via the carriage body and to conduct it back into the rails, for example on the guiding bogie. One disadvantage here would be, inter alia, that currents from other rail vehicles would also have to be drawn into the carriage body. Therefore, according to the invention, isolation of the current paths for transient, high-frequency interference current and low-frequency operating current with a frequency of, for example, 50 Hz advantageously takes place according to the invention by means of the capacitive connection between the carriage body of the rail vehicle and the axle arranged in the region of one end of the rail vehicle.

According to the invention, the vehicle antenna is arranged at a greater distance from the end of the rail vehicle than the axle, which is electrically connected to the carriage body. This means that the at least one vehicle antenna is arranged behind the axle which is electrically connected to the carriage body by means of the capacitive connection, when viewed from the end of the rail vehicle. This means that transient interference currents are conducted into the carriage body via the capacitive connection and therefore pass the vehicle antenna, which is arranged in a region below the carriage body and is directed onto the track, on its passive side. This interference current rerouting via the carriage body results in the interference current in the rails beneath the rail vehicle being reduced correspondingly, with the result that a markedly lower interference magnetic field is input onto the vehicle antenna. As a result, this therefore leads to a marked improvement or increase in the interference immunity of the vehicle antenna and therefore also of the entire train protection system in respect of high-frequency, in particular transient interference.

In accordance with a particularly preferred development, the rail vehicle according to the invention is configured such that the capacitive connection comprises a capacitor, which is connected electrically between the carriage body and the axle, and a grounding contact provided on the axle. This is advantageously a particularly simple embodiment of the capacitive connection which uses such tried-and-tested components.

Preferably, the rail vehicle according to the invention can also be developed such that the capacitive connection has a capacitance which is matched to the inductance of the electrical connection between the carriage body and the axle in such a way that the resultant resonant circuit has a resonant frequency in the region of a transmission frequency of the vehicle antenna. This means that the capacitance of the capacitive connection is selected such that it forms, in conjunction with the inductance of the feed line to the axle, i.e. for example to the grounding contact, a resonant circuit whose resonant frequency is in the region of a transmission frequency of the vehicle antenna. Therefore, the electrical resonant circuit formed by the capacitive connection and the inductance of the electrical connection has, at the relevant frequency, i.e. at the transmission frequency of the vehicle antenna, a particularly low complex impedance. As a result, the capacitive grounding is advantageously extended to "resonant-circuit grounding", which preferably causes dissipation of currents at frequencies in the region of the transmission frequency of the vehicle antenna. This is advantageous since, as a result, rerouting of the transient or in general high-frequency currents via the carriage body and therefore out of the active region of the vehicle antenna is also made possible for those train protection systems whose transmission frequency or whose transmission frequencies is/are in the megahertz range. As a result, an improvement in the interference immunity can be achieved, for example, also for the European Train Control System ETCS, whose reception channel operates in a frequency range around 4.2 MHz.

Preferably, the rail vehicle according to the invention can also be characterized by the fact that the carriage body and a further axle, which is arranged in the region of the other end of the rail vehicle, are electrically connected to one another by means of a further capacitive connection. This provides the advantage that a well-defined reverse current path is provided via the carriage body of the rail vehicle in both directions for the high-frequency transient interference currents.

Preferably, the rail vehicle according to the invention is in this case also developed in such a way that at least one further vehicle antenna is arranged at a greater distance from the other end of the rail vehicle than the further axle, which is electrically connected to the carriage body. This provides the advantage that a symmetrical arrangement with respect to both ends of the rail vehicle is provided, with the result that the rail vehicle can be used independently of the direction of travel and therefore particularly flexibly. In this case, consideration should be taken of the fact that vehicle antennas of train protection systems are generally arranged in a front region of a rail vehicle, when viewed in the direction of travel, in order to provide the possibility of data transmission to the rail vehicle as early as possible. In the mentioned embodiment of the rail vehicle according to the invention, high-frequency interference currents are advantageously conducted, independently of the direction of travel of the rail vehicle, in front of the vehicle antenna which is respectively active depending on the direction of travel, into the carriage body of the rail vehicle, as a result of which interference magnetic fields acting on the respective vehicle antenna can advantageously be considerably reduced.

In accordance with a further particularly preferred configuration of the rail vehicle according to the invention, the further capacitive connection comprises a further capacitor, which is connected electrically between the carriage body and the further axle, and a further grounding contact provided on the further axle. Analogously to the embodiments in this regard in conjunction with the capacitive connection, said capacitive connection is a particularly simple and at the same time robust embodiment of the further capacitive connection.

Preferably, the rail vehicle according to the invention is also developed such that the further capacitive connection has a capacitance which is matched to the inductance of the electrical connection between the carriage body and the further axle in such a way that the resultant further resonant circuit has a resonant frequency in the region of a transmission frequency of the further vehicle antenna. Corresponding to the embodiments in this regard in connection with the corresponding development of the rail vehicle according to the invention as regards the capacitive connection, it is thus also possible for effective rerouting of the corresponding interference currents via the carriage body of the rail vehicle to be brought about for interference frequencies in the megahertz range. In addition, the grounding of the carriage body via the further capacitive connection and the further axle in the form of an electrical resonant circuit is formed.

The rail vehicle according to the invention may in principle be a rail vehicle with any desired drive known per se. This also includes, in addition to vehicles driven by an electric motor, for example, diesel vehicles, steam locomotives or else vehicles with hydrogen drive. As has already been mentioned at the outset, vehicles without a dedicated electric motor can also be affected by interference currents which are caused by other vehicles.

In accordance with a further particularly preferred embodiment, the rail vehicle according to the invention is driven by an electric motor and has a transformer which can be linked to a catenary wire via a current collector. This is advantageous since corresponding rail vehicles driven by electric motor with AC-voltage supply are to a certain extent subject to transient interference owing to the link to the catenary wire, and therefore a particularly pronounced improvement in the interference immunity of the vehicle antenna or the train protection system is achieved for such rail vehicles.

In accordance with a further advantageous configuration of the rail vehicle according to the invention, the carriage body and the reverse current path of the transformer are electrically connected to one another by means of a first additional capacitive connection. As a result, advantageously a further reduction in interference currents in the region below the vehicle antenna can be achieved, with the result that the interference immunity of the vehicle antenna or the train protection system is advantageously further increased. In order to achieve a best-possible effect, the additional capacitive connection should advantageously be realized such that a first additional capacitor is looped in or arranged with a low inductance between the reverse current path or the reverse current line of the transformer and the carriage body. This can take place, for example, such that the reverse current conductor is guided directly via the first additional capacitor, while the other terminal of the first additional capacitor is connected to the carriage body areally, for example via a short contact rail.

Preferably, the rail vehicle according to the invention can also be configured such that the carriage body and the high-voltage side of the transformer are electrically connected to one another by means of a second additional capacitive connection. Analogously to the embodiments in connection with the first additional capacitive connection, in addition or as an alternative to this, a targeted introduction of transient interference currents, which originate in the catenary wire or in the respective rail vehicle or in the interaction between said catenary wire and rail vehicle, into the carriage body of the rail vehicle can also take place by means of the second additional capacitive connection.

In accordance with a further particularly preferred embodiment, the rail vehicle according to the invention is developed such that the rail vehicle has an electric-motor drive with a DC-supplied traction assembly. In this case, the traction assembly comprises, in addition to at least one traction current converter, possibly a line filter connected upstream of the traction current converter. The mentioned preferred development of the rail vehicle according to the invention is advantageous since corresponding rail vehicles driven by electric motor with DC-voltage supply are subjected to transient interference, in the same way as the previously discussed vehicles with AC-voltage supply, owing to the link to the catenary wire, and therefore a particularly pronounced improvement in the interference immunity of the vehicle antenna or the train protection system can also be achieved for such rail vehicles.

Preferably, the rail vehicle according to the invention is in this case configured further such that the carriage body and the reverse current path of the traction assembly are electrically connected to one another by means of a third additional capacitive connection.

In accordance with a further particularly preferred development of the rail vehicle according to the invention, the carriage body and the high-voltage side of the input of the traction assembly are electrically connected to one another by means of a fourth additional capacitive connection.

The advantages of the two previously mentioned preferred developments of the rail vehicle according to the invention in the case of a DC-voltage supply substantially correspond to the previously described preferred developments of the rail vehicle according to the invention in the case of an AC-voltage supply, with the result that, in this regard, reference is made to the respective preceding statements. Reference is made to the fact that the rail vehicle can also be a multiple system vehicle, which is intended both for AC-voltage supply and for DC-voltage supply.

The vehicle antenna can in principle be a vehicle antenna of any desired train protection system. It is merely essential here that the vehicle antenna is directed toward the track, i.e. is generally fitted beneath the carriage body or on a bogie in order to provide the possibility of communication with a line-side device arranged in the track. The line-side device can be in particular a balise, for example in the Spanish national train protection system ASFA.

In accordance with a further particularly preferred embodiment of the rail vehicle according to the invention, the at least one vehicle antenna is a vehicle antenna of the European Train Control System ETCS. This is advantageous since it has been shown that ETCS also has sensitivity to interference currents in the tracks. It should be taken into consideration here that interference in the ETCS generally results in forced braking of the respective vehicle, as a result of which considerable delays and disruption of rail traffic can occur. Advantageously, the rail vehicle according to the invention therefore provides the possibility of improving, on the vehicle side, the interference immunity of this comparatively new train protection system provided for the whole of Europe.

In accordance with a further particularly preferred development, the rail vehicle according to the invention is an electrical multiple unit. This is advantageous since in particular even in the case of electrical multiple units with distributed traction, interference in the vehicle antenna or the respective train protection system as a result of high-frequency interference currents in the rails can be observed.

The invention will be explained in more detail below with reference to an exemplary embodiment. In this regard,

BRIEF DESCRIPTION OF THE DRAWING

FIGURE shows a simplified schematic illustration of an exemplary embodiment of the rail vehicle according to invention.

DESCRIPTION OF THE INVENTION

The FIGURE illustrates a rail vehicle 1 in the form of an electrical multiple unit. For reasons of clarity, only one half of the train is depicted. The rail vehicle 1 has an end carriage 2, a transformer carriage 3 and an only partially illustrated central carriage 4. The carriages 2, 3, 4 each have a carriage body 5*a*, 5*b*, 5*c* and bogies 6*a*, 6*b*, 6*c*, 6*d*, 6*e* with axles or wheels 7*a*, 7*b*, 7*c*, 7*d*, 7*e*, 7*f*, 7*g*, 7*h*, 7*i*, 7*j*.

It should be emphasized that the illustration in the FIGURE is merely a very simplified, schematic illustration for the purpose of explaining the invention. Furthermore, it is noted that the carriage bodies 5*a*, 5*b*, 5*c* of the carriages 2, 3, 4 of the rail vehicle 1 are also referred to in their entirety as carriage body below. This applies firstly against the background that the invention described with reference to the exemplary embodiment is also applicable for rail vehicles with a continuous carriage body; furthermore, the carriage bodies 5*a*, 5*b*, 5*c* of the carriages 2, 3, 4 in the exemplary embodiment in the FIGURE are electrically connected to one another via potential-compensating conductors 12*a*, 12*b*, with the result that they can also be considered as one unit from an electrical point of view.

Corresponding to the illustration in the FIGURE, the transformer carriage 3 is connected electrically to a catenary wire 35 via a current collector 15. The electrical energy drawn from the catenary wire 35 is in this case supplied via a master switch 14 on the high-voltage side of a transformer 13 of the rail vehicle 1. This is therefore a conventional link between the electric motors of an AC-fed rail vehicle driven by electric motor and the catenary wire 35 or the corresponding high-voltage system.

It is noted that the following statements substantially apply analogously for the case of a rail vehicle which is driven by an electric motor and has a DC-voltage supply, for example by means of a DC voltage of 600 V, 750 V, 1.5 kV or 3 kV. In this case, substantially only the transformer 14 can be replaced by a traction assembly in the FIGURE, said traction assembly comprising, in addition to at least one traction current converter, possibly a line filter which is connected upstream of the traction current converter, the remaining components thereof remaining largely untouched. Furthermore, the rail vehicle may also be a multiple-system vehicle, which is intended both for DC-voltage supply and for AC-voltage supply, wherein the following exemplary embodiments are applicable in each case for both systems.

The transformer carriage 3, or to be more precise the axles 7*f* and 7*g* of the transformer carriage 3, have grounding contacts 10*a*, 10*b* for the operational grounding. Furthermore, a grounding contact 11 for protective grounding is provided for the axle 7*j* of the central carriage 4.

In the event that the abovementioned components are provided on their own, transient interference which results between the current collector 15 and the catenary wire 35 would pass via parasitic capacitances $C_P$ and $C_D$ onto the carriage body 5*b* of the transformer carriage 3. From there, the high-frequency interference current capacitively input in such a way would flow via the potential-compensating conductor 12*b* to the central carriage and pass via the grounding contact of the protective grounding 11 onto the rails 30. Furthermore, interference currents would also pass directly via the master switch 14 or, in particular if the master switch 14 is open, via the parasitic capacitance $C_{HS}$ of the master switch 14 and via the parasitic winding capacitance $C_{TR}$ of the transformer 13 and the grounding contacts for the operational grounding 10*a*, 10*b* onto the rails 30. If a corresponding interference current now passes the rails or the track 30 at the level of a vehicle antenna 25 of a train protection system, the magnetic field surrounding the interference current is input onto the vehicle antenna 25. Depending on the modulation, the frequency range and the amplitude of the signal transmission of the train protection system to which the vehicle antenna 25 belongs, interference can result in the reception channel of the train protection system as a result of the useful magnetic field of the vehicle antenna 25 being superimposed on this transient magnetic field.

In particular electrical multiple units with AC and/or DC operation with distributed traction are affected by interference currents of the previously described type. Furthermore, in particular those types of train protection systems which function at a given time in each case not with two vehicle antennas, but only with one vehicle antenna, are susceptible to corresponding interference. The reason for this is that, when using only one vehicle antenna, there is no possibility of common-mode rejection of the interference fields. Corresponding train protection systems which each have only one active vehicle antenna generally use balises in the track bed.

In order now to increase the interference immunity of corresponding train protection systems by vehicle-side measures, the carriage body 5*a*, 5*b*, 5*c* of the rail vehicle 1 and an axle 7*a*, which is arranged in the region of one end of the rail vehicle 1, are electrically connected to one another by means of a capacitive connection. In this case, the capacitive connection comprises a capacitor 16, which is connected electrically between the carriage body 5*a*, 5*b*, 5*c* and the axle 7*a*, and a grounding contact 17 provided on the axle 7*a*. This means that the first axle 7*a* of the rail vehicle 1 is connected to the carriage body 5*a*, 5*b*, 5*c* of the rail vehicle 1 via the capacitor 16. Preferably, furthermore a further axle also has a further grounding contact in the region of the other end (not illustrated in the FIGURE) of the rail vehicle 1 and is linked likewise to the carriage body 5*a*, 5*b*, 5*c* of the rail vehicle 1 by means of this further grounding contact and via a further capacitor.

Corresponding to the illustration in the FIGURE, the vehicle antenna 25 is arranged behind the axle which is connected electrically to the carriage body 5*a* of the rail vehicle 1, in relation to a direction of travel running toward the left, i.e. the vehicle antenna 25 has a greater distance from that end of the rail vehicle 1 in whose region it is arranged than the axle 7*a* which is electrically connected to the carriage body 5*a*. In this case, the vehicle antenna 25 is preferably arranged after the first bogie 6*a* of the rail vehicle 1, for space reasons.

As a further measure for reducing the interference currents acting on the vehicle antenna 25, the carriage body 5*b* of the transformer carriage 3 and the reverse current path of the transformer 13 are electrically connected to one another by means of a first additional capacitive connection. For this purpose, first additional capacitors 19*a* and 19*b* are provided. The first additional capacitors 19*a*, 19*b* therefore cause high-frequency currents to be introduced likewise into the carriage body 5*a*, 5*b*, 5*c* of the rail vehicle 1 from the reverse current path of the transformer 13.

As an alternative or in addition to the abovementioned measure, the FIGURE furthermore also shows the possibility of the carriage body 5*a*, 5*b*, 5*c* of the rail vehicle 1 and the high-voltage side of the transformer 13 being electrically connected to one another by means of a second additional capacitive connection. In this case, the second additional capacitive connection has a second additional capacitor 20 in the form of a high-voltage capacitor. As a result, high-frequency interference currents are conducted into the carriage body 5*a*, 5*b*, 5*c* of the rail vehicle 1, or more precisely into the carriage body 5*b* of the transformer carriage 3, even on the high-voltage side of the transformer 13.

The routes of the transient interference current resulting from the previously described measures being taken into consideration are indicated in the FIGURE by corresponding small arrows. Thus, the transient interference currents which are input from the roofgarden capacitively into the carriage body 5*b* of the transformer carriage 3 remain owing to the inductive coupling between the carriage body 5*b* of the transformer carriage 3 and the catenary wire 35, preferably in the carriage body 5*b* of the transformer carriage 3. The interference currents then pass to the end carriage 2 via the potential-compensating conductor 12*a* and there flow via the capacitor 16 and the grounding contact 17 into the rails or the track 30.

The proportion of the transient interference current which flows via the winding capacitance $C_{TR}$ of the transformer 13 passes via the first additional capacitors 19*a*, 19*b* between the reverse current path of the transformer 13 and the carriage body 5*b* of the transformer carriage 3 onto the carriage body 5*b* and from there flows again via the potential-compensating conductor 12*a* and the capacitor 16 and the grounding contact 17 into the rails 30. If, in addition or as an alternative to the first additional capacitors 19*a*, 19*b* in the reverse current path of the operating current, the second additional capacitor 20 is arranged in the high-voltage path of the transformer 13, the high-frequency component of the current also in this case takes the path via the potential-compensating conductor 12*a*, the carriage body 5*a*, the capacitor 16 and the grounding contact 17 and the axle 7*a* into the rails or the track 30.

At this juncture, reference is once again made to the fact that only part of the rail vehicle 1 is illustrated in the FIGURE. If the rail vehicle 1 has a further transformer carriage, this transformer carriage preferably corresponds to the transformer carriage 3 illustrated as regards the components provided. The same applies analogously as regards the design of the other end carriage of the rail vehicle 1.

In the above-described cases, the transient interference current therefore owing to the inductive coupling to the overhead line, i.e. to the catenary wire 25, and the very low-impedance, highly conductive carriage body 5*a*, 5*a*, 5*c* as reverse current path preferably the carriage body 5*a*, 5*b*, 5*c*, with the result that now only a small proportion of the interference current flows beneath the rail vehicle 1 into the rails 30. As a result of the vehicle antenna 25 being arranged behind the capacitive grounding of the carriage body 5*a*, 5*b*, 5*c*, i.e. behind the capacitive connection between the carriage body 5*a* and the axle 7*a*, a markedly smaller interference magnetic field is input onto the vehicle antenna 25 since the interference current in the region of the rails or the track 30 beneath the rail vehicle 1 has become correspondingly smaller owing to the rerouting of the in particular transient interference currents via the carriage body 5*a*, 5*b*, 5*c*. As a result, the interference immunity of the vehicle antenna 25 or the associated train protection system is advantageously markedly improved.

In order to improve the interference immunity in a corresponding manner also for vehicle antennas with high transmission frequencies, i.e. approximately in the megahertz range, the capacitive connection advantageously has a capacitance which is matched to the inductance 18 of the electrical connection between the carriage body 5*a* of the end carriage 2 and the axle 7*a* in such a way that the resultant resonant circuit has a resonant frequency in the region of a transmission frequency of the vehicle antenna 25. If corresponding matching were not to be performed, the inductance of the connecting line between the capacitor 16 and the wheel ground or grounding contact 17 at high frequencies would form an excessively high complex impedance with the result that the dissipation of the interference via the capacitor 16 would under certain circumstances no longer take place to a satisfactory extent.

By matching the capacitance of the capacitor 16 to the inductance 18 of the connecting line, "resonant-circuit grounding" matched to the transmission or signaling frequency of the vehicle antenna 25 is now realized. As a result, a dissipation of the interference currents is ensured to a reliable extent even for high frequencies, for example in the megahertz range. This provides the advantage that an increase in the interference immunity is possible, for example even for the European train control system ETCS, which operates in the reception channel in a frequency range around approximately 4.2 MHz.

Reference is made to the fact that the described principle of the matched resonant circuit can be used in a corresponding manner in principle also as regards the first additional capacitors 19*a*, 19*b* or as regards the second additional capacitor 20. This applies in particular for the case in which a low-inductance link between the high-voltage or reverse current line and the carriage body 5*a*, 5*b*, 5*c* is not possible here since, for example, spur lines to the first additional capacitors 19*a*, 19*b* or to the second additional capacitor 20 are required.

The text which follows describes, by way of example, a possible procedure for matching of the capacitance of the capacitive connection, i.e. the capacitor 16, to the inductance 18 of the electrical connection between the carriage body 5*a* and the axle 7*a*. This can thus take place, for example, in such a way that the capacitance 16, i.e. the resonant circuit capacitance, is determined uniquely for a vehicle series, preferably on the first constructed vehicle. In this regard, initially the capacitance 16 can be determined computationally given an estimated line inductance of approximately 1 μH/m, for example, of the connecting line to the grounding contact 17 and a given reception frequency of the train protection system, in protection accordance with the following formula:

$$C = \frac{1}{L*(2*\pi*f)^2},$$

where C denotes the capacitance, L denotes the inductance and f denotes the reception or transmission frequency of the train protection system.

Then, a capacitor with the thus determined capacitance can be introduced or looped into the connecting line to the wheel ground or grounding contact 17. In this case, the real installed situation of the capacitor 16 for the series solution needs to be replicated precisely in order to also take into consideration the influence of parasitic capacitances and inductances even in the trial design. In a trial, the resonant frequency of the thus formed resonant circuit can then be determined. This can take place, for example, such that the feedline to the grounding contact 17 has a conductor wound around it, said conductor short-circuiting an output of a test generator with an internal resistance of 50Ω, for example. The voltage across the capacitor 16 is tapped off and measured, which can take place, for example, by means of an oscilloscope and an upstream 10:1 probe with an internal resistance of 10 MΩ. By varying the frequency, the voltage maximum in the capacitor 16 is determined and the corresponding frequency read. Taking into consideration the parasitic capacitance of the probe, the line inductance can now be determined precisely. On renewed measurement with a capacitor 16 having a correspondingly modified capacitance, the frequency at which the voltage maximum occurs, should then substantially correspond to the transmission frequency of the train protection system.

It is generally desirable to keep component tolerances as low as possible in different vehicles in a series in order that the previously described compensation step only needs to be performed once. This can be achieved for the line inductance by a constant length of the capacitive connection and the same laying path through cable clips to the grounding contact 17. Preferably, the capacitor 16 should furthermore have a tolerance and temperature and long-term drift which are as low as possible.

If the magnification factor of the resonant circuit is comparatively low, i.e. there is no excessive overshoot of the resonance curve, this has the effect or advantage that, in this case, the resonant circuit has a wide-band action and component tolerances or drifts have a comparatively small influence on the effectiveness of the circuit.

Corresponding to the above-described exemplary embodiment, the rail vehicle according to the invention makes it possible, by comparatively simple measures, on the vehicle side which are associated with comparatively low cost expenditure, to markedly improve the interference immunity of vehicle antennas directed onto the track or the associated train protection systems.

The invention claimed is:

1. A rail vehicle, comprising:

carriage body and an axle arranged in a vicinity of an end of the rail vehicle, said carriage body and said axle being electrically connected to one another by way of a capacitive connection;

at least one vehicle antenna of a train protection system, said vehicle antenna being directed toward the track; and said at least one vehicle antenna being arranged at a greater distance from said end of the rail vehicle than said axle that is electrically connected to said carriage body.

2. The rail vehicle according to claim 1, wherein said capacitive connection comprises a capacitor, which is connected electrically between said carriage body and said axle, and a grounding contact on said axle.

3. The rail vehicle according to claim 1, wherein said capacitive connection has a capacitance that is matched to an inductance of the electrical connection between said carriage body and said axle, such that a resultant resonant circuit has a resonant frequency in a range of a transmission frequency of said at least one vehicle antenna.

4. The rail vehicle according to claim 1, which comprises a further axle disposed in a vicinity of another end of the rail vehicle, and a further capacitive connection electrically connecting said further axle and said rail vehicle.

5. The rail vehicle according to claim 4, which comprises at least one further vehicle antenna arranged at a greater distance from the other end of the rail vehicle than said further axle.

6. The rail vehicle according to claim 4, wherein said further capacitive connection comprises a further capacitor, which is connected electrically between said carriage body and said further axle, and a further grounding contact disposed on said further axle.

7. The rail vehicle according to claim 4, wherein said further capacitive connection has a capacitance which is matched to an inductance of the electrical connection between said carriage body and said further axle such that a resultant further resonant circuit has a resonant frequency in a range of a transmission frequency of said further vehicle antenna.

8. The rail vehicle according to claim 1, which further comprises an electric motor for driving the rail vehicle and a transformer to be linked to a catenary wire via a current collector.

9. The rail vehicle according to claim 8, wherein said carriage body and a reverse current path of said transformer are electrically connected to one another by way of a first additional capacitive connection.

10. The rail vehicle according to claim 9, wherein said carriage body and a high-voltage side of said transformer are electrically connected to one another by way of a second additional capacitive connection.

11. The rail vehicle according to claim 1, which comprises an electric-motor drive with a DC-supplied traction assembly.

12. The rail vehicle according to claim 11, wherein said carriage body and a reverse current path of said traction assembly are electrically connected to one another by way of an additional capacitive connection.

13. The rail vehicle according to claim 12, wherein said carriage body and a high-voltage side of an input of said traction assembly are electrically connected to one another by way of an additional capacitive connection.

14. The rail vehicle according to claim 11, wherein said at least one vehicle antenna is a vehicle antenna configured according to European Train Control System ETCS.

15. The rail vehicle according to claim 11, wherein the rail vehicle is an electrical multiple unit.

* * * * *